US005437358A

United States Patent [19]

Schiffelholz

[11] Patent Number: 5,437,358

[45] Date of Patent: Aug. 1, 1995

[54] DEVICE FOR CHECKING THE MARKING OF A CUP IN CUP RETURN AUTOMATS

[76] Inventor: Max Schiffelholz, Peter-Henlein-Strasse 10, D 8870 Günzburg, Germany

[21] Appl. No.: 39,113

[22] PCT Filed: Aug. 10, 1992

[86] PCT No.: PCT/EP92/01820

§ 371 Date: May 24, 1993

§ 102(e) Date: May 24, 1993

[87] PCT Pub. No.: WO93/03461

PCT Pub. Date: Feb. 18, 1993

[30] Foreign Application Priority Data

Aug. 8, 1991 [DE] Germany ..... 41 26 258.1

[51] Int. Cl.[6] ..... G07F 7/06; B07C 5/342

[52] U.S. Cl. ..... 194/212; 209/524; 209/538

[58] Field of Search ..... 194/208, 209, 212, 213; 209/524, 538, 583

[56] References Cited

U.S. PATENT DOCUMENTS

| | | | |
|---|---|---|---|
| 4,245,731 | 1/1981 | Herbst et al. . | |
| 4,248,389 | 2/1981 | Thompson et al. . | |
| 4,284,334 | 2/1981 | Hanley et al. . | |
| 4,316,533 | 2/1982 | Hughes et al. | 209/587 X |
| 4,919,274 | 4/1990 | Hammond | 194/208 X |
| 4,953,682 | 9/1990 | Helbawi | 194/208 |

FOREIGN PATENT DOCUMENTS

| | | | |
|---|---|---|---|
| 0301978 | 2/1989 | European Pat. Off. | 194/209 |
| 2580418 | 4/1985 | France | 194/208 |
| 2631477 | 5/1988 | France . | |
| 2645305 | 2/1989 | France . | |

OTHER PUBLICATIONS

Patent abstracts of Japan, vol. 1, No. 58 (E-24) Jun. 6, 1977 & JP, A, 52 0 498 (Kishiro Sanso) Jan. 5, 1977.

*Primary Examiner*—F. J. Bartuska

*Attorney, Agent, or Firm*—Knobbe, Martens, Olson & Bear

[57] ABSTRACT

The device has a guide cylinder (8) receiving the cup (5), with a window (11) provided in the sidewall of the cylinder, further a reflective light beam detector (12) arranged outside the guide cylinder (8) close to the window (11), with a detection region directed through the window (11) into the interior space (13) of the guide cylinder (8), which detector in combination with a following signal processing circuit detects and evaluates the marking (4) located on the cup (5), and a catch member (17) and a positioning member (20), which are both arranged in axial projection diametrically opposite the window (11) and in the direction of the axis (16) of the guide cylinder (8) below the window (11), with the positioning member (20) between the window (11) and the catch member (17), and with each movable into and/or out of the interior space (13) of the guide cylinder (8) by its own controllable drive member (18, 21).

23 Claims, 6 Drawing Sheets

DEVICE FOR CHECKING THE MARKING OF A CUP IN CUP RETURN AUTOMATS

This invention relates to a device for checking the marking of a cup for the purposes of cup acceptance in cup return automats.

Cup return automats should provide an incentive for used cups, especially drinking cups, to be collected and passed on to an organized waste disposal facility and if desired waste recycling. Accordingly, the new cups are dispensed in return for a deposit, which is refunded by cup return automats on insertion of the used cup. In order to prevent misuse, the cup is provided with a suitable marking. The acceptance of the used cup by the cup return automat, or at least the return of deposit, only then takes place when the cup is actually one with the right marking and the marking is recognized as correct by the cup return automat. In order that such a disposal system can be implemented in practice, the device used in the cup return automat to check the cup marking and for cup acceptance must not only work reliably by also have as simple and inexpensive a construction as possible, so that the installation of such automats is within one's means and justifiable in cost terms.—The invention is based on the object of providing a device of the kind initially referred to fulfilling these requirements.

The device according to the invention meeting this object is characterized by a guide cylinder receiving the cup, with upper and lower open ends and a window provided in the sidewall of the guide cylinder, further by at least one reflective light beam detector arranged outside the guide cylinder close to the window, with a detection region directed into the interior space of the guide cylinder, further by a signal processing circuit connected electrically to the light beam detector and which evaluates the marking located on the cup and detected by the light beam detector, and by a catch member and a positioning member, which are both arranged in axial projection diametrically opposite the window and in the direction of the axis of the guide cylinder below the window, with the positioning member lying between the window and the catch member, and which are both movable by their own controllable drive members into and/or out of the interior space of the guide cylinder, whereby, in its state positioned in the interior space, the catch member forms a stop for the cup rim preventing the cup falling through the guide cylinder, and the positioning member applies the cup held on the catch member with the cup wall against the margin of the window.

The advantages obtained with the invention consist firstly in the use of reflective light beam detectors with associated signal processing circuits, which are available inexpensively in the trade for testing the markings on marking carriers, provided however that the marking carrier can be approached closely to the reflective light beam detector. In the framework of the invention, this requirement is met with the aid of the catch member and the positioning member, through which the cup in the guide cylinder is tilted in the direction against the window and is applied with its sidewall carrying the marking against the margin of the window, which brings the marking very close to the reflective light beam detector, so that a reliable marking test is possible. A further advantage arises in that the guide cylinder in conjunction with the catch member only make acceptance of the cup possible with the cup has a position and orientation determined by the guide cylinder and catch member, in which the further handling of the cup, especially stacking the cups in space-saving cup columns, is facilitated. A particularly advantageous embodiment in this respect is characterized in that the reflective light beam detector and the catch member are so spaced from one another in the axial direction of the guide cylinder that, with a cup held on the catch member, the cup marking is only at the height of the reflective light beam detector when the cup is located in the guide cylinder with the mouth of the cup directed downwards, and in that a stacking shaft is provided below the guide cylinder and receives the cup falling down out of the guide cylinder after release of the catch member in order to form a cup stack. By receiving the cup only with its mouth directly downwards it is not only ensured that cup contents possibly remaining in the cup run out and can be caught in a suitably arranged collecting tray, but that the received cups entering the stacking shaft also all have the same orientation and therefore can be immediately stacked in and over one another. Yet another advantage is to be seen in that the catch member controlled by the results of the marking test effects the cup acceptance so that, with negative test results, the cup which is not to be accepted remains in the guide cylinder, held by the catch member and can be withdrawn by hand and is necessary be inserted in the guide cylinder again in inverted, correct orientation.

A preferred embodiment is characterized in that the catch member is a rod movable in the direction of its axis, which runs in a plane passing through the axis of the guide cylinder and through the opening of the window, and the drive member for the catch member is formed as a linear motor acting on the rod in its longitudinal direction and which retracts the catch member from the interior space against the force of a spring, which holds the catch member in its position inserted into the interior space of the guide cylinder. Correspondingly it is advantageous in relation to the positioning member that the positioning member is therefore a rod movable in the direction of its axis, which runs in a plane passing through the axis of the guide cylinder and through the opening of the window, and the drive member for the positioning member is a linear motor acting on the rod in its longitudinal direction and which inserts the positioning member into the interior space against the force of a spring which holds the positioning member in its position out of the interior space of the guide cylinder. In order to apply the cup against the margin of the window it is advantageous if, according to a further proposal, the catch member or the positioning member is inclined downwards towards the rod end on the guide cylinder side, the rod axis making an angle of approximately 10° with the horizontal. With advantage, the drive members for the catch member and the positioning member are electrically actuated pull magnets. It is further recommended that, with a rod-like construction of both the catch member and the positioning member, the axes of both rods run in a common plane and parallel to one another.

If the marking of a cup is damaged or dirty in places, the marking test can easily lead to a negative result for the cup acceptance, if the cup is so placed in the guide cylinder that the damaged or dirty marking part lies opposite the reflective light beam detector. An embodiment which avoids this danger and is therefor particularly advantageous is characterized in that the guide cylinder comprises a device for rotating about the cup axis the cup held on the catch member and applied against the window margin by the positioning member, wherein a clear space exists between the window margin and the positioning member inserted into the interior space of the guide cylinder which leaves a small amount of radial play for the cup therebetween, facilitating its rotary movement, and in that the testing of the cup marking by the reflective light beam detector and signal processing circuit is repeatable during the cup rotation. The advantage lies in that the marking is tested many times and in different positions of the periphery of the cup. Only when even this repeated test of the marking does not lead to success is the cup acceptance or return of the deposit finally denied.

The rotation of the cup can be effected in a surprising simple manner by a plunger, which can be moved forward in its longitudinal direction against the cup sidewall from a position withdrawn from the interior space of the guide cylinder, with repeated knocking into the interior space with abutment of the head of the plunger against the cup sidewall, the plunger being arranged spaced in the peripheral direction of the guide cylinder from the positioning member and approximately at the same height as this member. The plunger generates elastic deformations in the cup sidewall otherwise in abutment with the margin of the window and the positioning member on striking against the cup wall. These deformations bounce back into the original cup shape when the plunger springs back again, which apparently forms the basis for a knock by knock stepwise rotation of the cup, the direction of rotation of the cup being directed against the striking direction of the plunger. This kind of cup rotation in any case functions well in practice when the plunger runs in a plane parallel to the axis of the guide cylinder and which intersects the plane which passes through the axis of the guide cylinder and opening of the window, between the axis of the guide cylinder and the margin of the window. Especially good results are obtained for the cup rotation however in the limit case in which the plane containing the axis of the plunger passes through axis of the guide cylinder. Advantageously then with rod-like catching and positioning members, the plane defined by their rod axes and the plane containing the axis of the plunger make an angle with each other of 30°. Moreover the plunger should be inclined to the horizontal in the same manner as the catching and positioning members, the plunger axis being directed approximately perpendicular to the axis of the cup applied against the margin of the window. In addition it is advantageous if the plunger is held by a spring in a retracted position out of the interior space of the guide cylinder, against the force of which spring the plunger is struck forward against the cup by an electromagnetic drive. The magnetic drive can in particular operate as a pull magnet.

In order to be able to adapt the marking test to cups which carry the marking at different heights on the cup wall, it is advantageous if the window extends in the direction of the axis of the guide cylinder over a part of the cup height and the reflective light beam detector is adjustable in this direction over the height of the window. It is further advantageous if the reflective light beam detector comprises a plurality of at least two light tracks lying one above the other in the axial direction for testing the marking. This facilitates numerous variations in the marking as also the differentiation between them in the cup testing, so that—in conjunction also with the adjustment of the reflective light beam detector in the direction of the cup height—the marking test can be converted without difficulty to and from different cup markings.

The invention will be explained below in more detail with reference to an embodiment shown in the drawings, in which.

Figure 1:
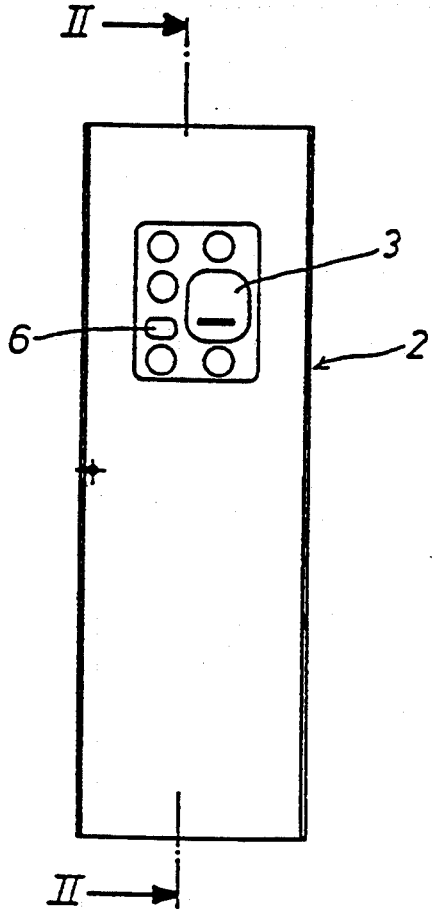
FIG. 1 is a front view of a cup return automat.
Figure 2:
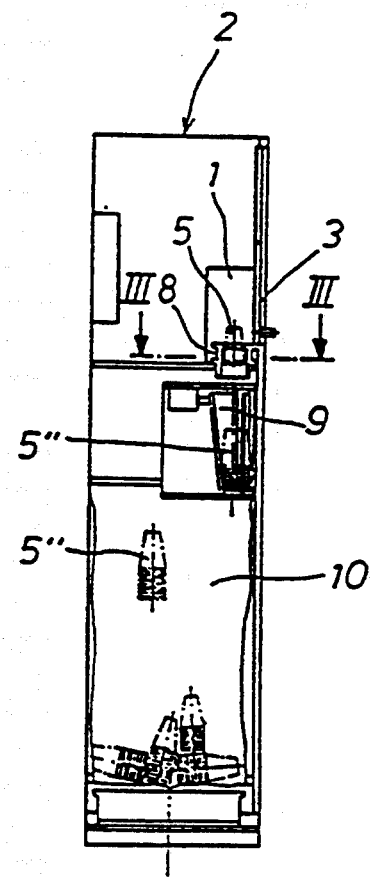
FIG. 2 is the section II—II in FIG. 1.
Figure 7:
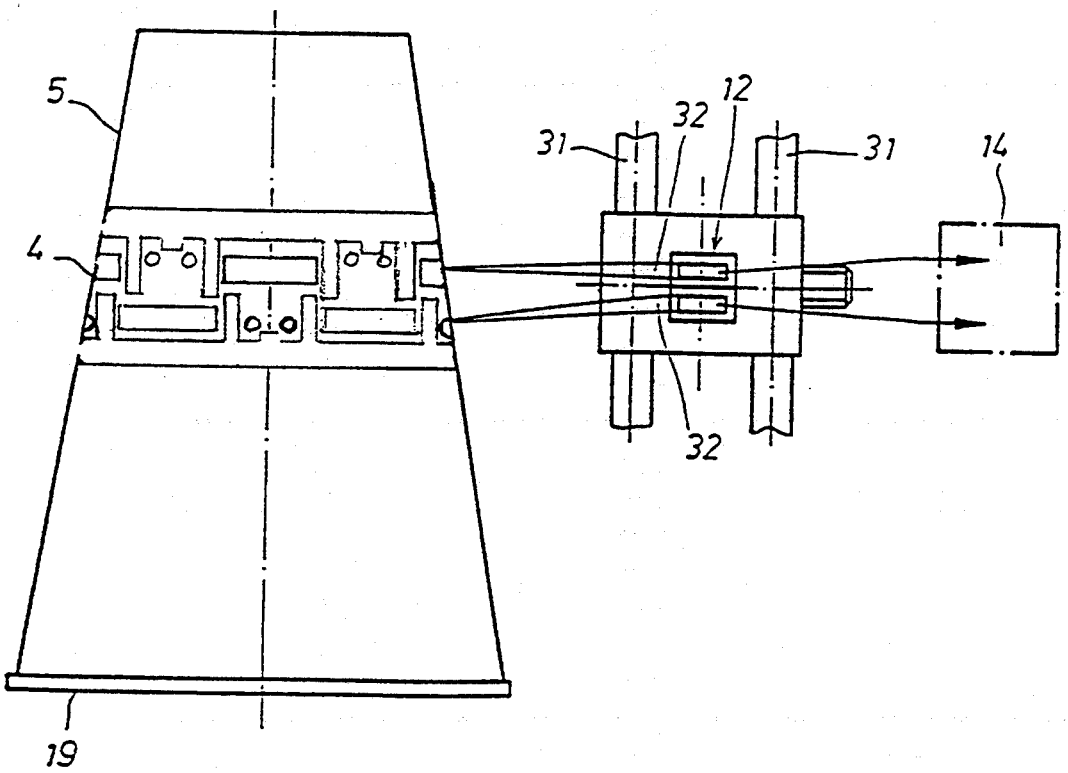
FIG. 7 shows a cup in side view with a front view of the reflective light beam detector in the direction of the arrow VII in FIG. 6.

The cup return automat 2 shown in FIGS. 1 and 2 has a cup insertion chamber 1, which can be closed on the outside by a sliding door 3. A return of deposit results from an inserted cup 5 correctly recognized by the cup return automat 2 and accepted—on the basis of its marking 4 (cf. FIGS. 4, 5 and 7); the deposit can be taken from a return opening 6. At the bottom 7 of the cup insertion chamber 1 there adjoins a guide cylinder 8 receiving the cup 5, being open at the top to the cup insertion chamber 1 and open at the bottom. Below the guide cylinder 8 there is provided a stacking shaft 9 in which the cups 5 falling down out of the guide cylinder 8 are stacked in cup columns 5''. When the stacking shaft 9 is full, the cup column 5'', which can comprise approximately 38 cups, is pushed sideways out of the stacking shaft 9 into a collecting chamber 10, which can be effected in various ways and is not described here in more detail.

In the sidewall of the guide cylinder 8 there is provided a window 11, on the outside of which is arranged a reflective light beam detector 12 close to the guide cylinder 8, with its detection region extending through the window 11 into the interior space 13 of the guide cylinder 8. The reflective light beam detector 12 comprises closely arranged light emitting and light receiving elements. The latter receives the part of the light emitted by the emitting element reflected by the marking in the detection region. The reflective light beam detector 12 is electrically connected to a signal processing circuit 14 merely indicated schematically in FIG. 7, which evaluates the marking 4 detected by the reflective light beam detector 12 with a cup 5 located in the guide cylinder 8 with the marking 4 against the margin 15 of the window and, in a manner yet to be described, releases the passage of the correctly recognized cup 5 through the guide cylinder 8 and the return of the deposit. In the case of a false or even a lacking marking 4 however, the cup 5 stays in the guide cylinder 1 and must be removed by hand and possibly be turned over, so that it has the right orientation for the stacking of the cup 5 in the stacking shaft 9. If the cup 5 is then still not correctly recognized, no return of deposit takes place.

Figure 4:
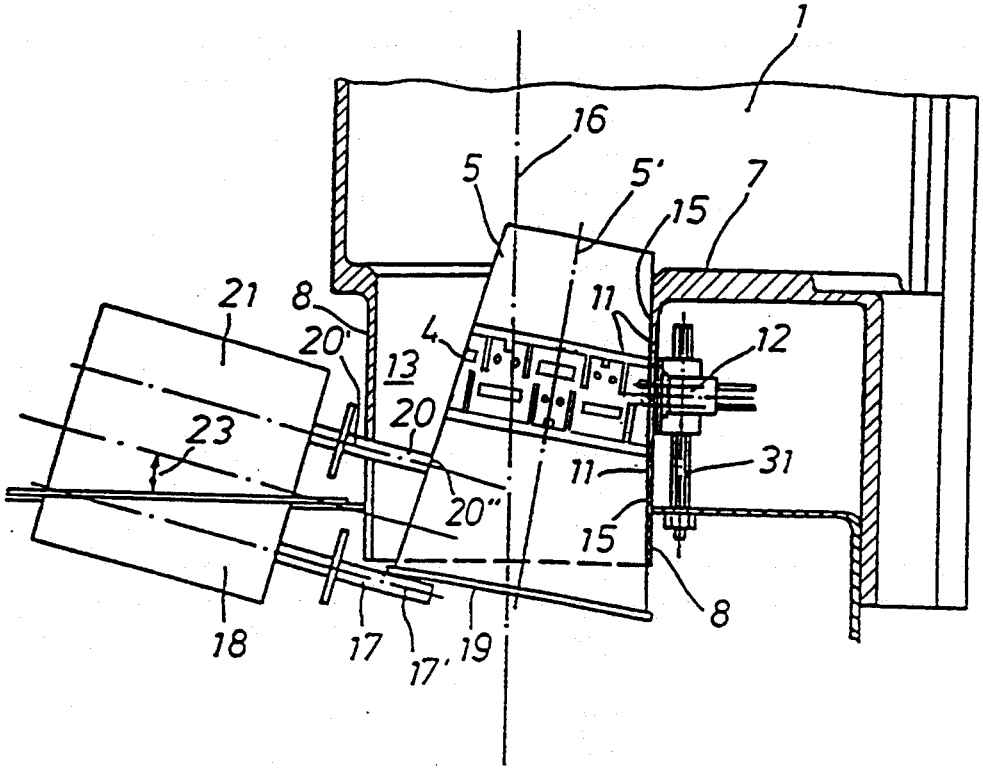
FIG. 4 is the section IV—IV in FIG. 3.
Figure 5:
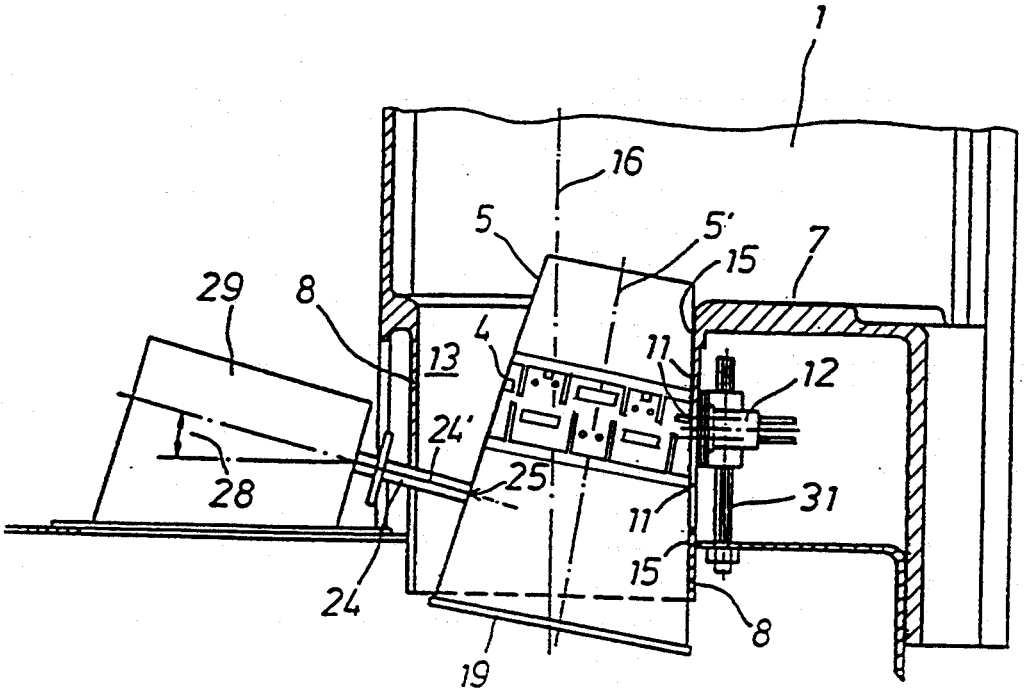
FIG. 5 is the section V—V in FIG. 3.

The passage of the cup 5 through the guide cylinder 8 is determined by a catch member 17 arranged in axial projection diametrically opposite the window 11 and in the direction of the axis 16 of the guide cylinder 8 below the window 11, and which member can be moved into and out of the interior space 13 of the guide cylinder 8 by a drive member 18 controlled by the signal processing circuit 14, whereby the catch member 17 forms a stop for the cup rim 19 preventing the cup falling through the guide cylinder 8 in the inserted state. The arrangement of the catch member 17 diametrically opposite the window 11 and the reflective light beam detector 12 has the result that the cup 5 inserted in the guide cylinder 8 tilts against the wall of the guide cylinder 8 in the region of the window 11 and the reflective light beam detector 12, as is apparent from FIGS. 4 and 5. This tilting of the cup and application of the cup wall bearing the marking 4 against the margin of the window 11 is moreover ensured by a positioning member 20, which is likewise arranged in axial projection diametrically opposite the window 11 and in the direction of the guide cylinder axis 16 between the catch member 17 and the reflective light beam detector 12, and which member 20 is movable into and out of the interior space 13 of the guide cylinder 8 by its own drive member 21, whereby in the position moved into the interior space 13, the positioning member 20 applies the wall of the cup 5 held on the catch member 17 against the margin 15 of the window 11, as is shown in FIGS. 4 and 5. The marking 4 of the cup 5 is thus located close to the reflective light beam detector 12, so that reliable detection and testing of the marking can take place.

In detail, the catch member 17 is a rod movable in the direction of its axis 17', which runs in a diametral plane 22 passing through the axis 16 of the guide cylinder 8 and through the opening of the window 11. The drive member 18 for the catch member 17 is formed as a magnetic drive acting on the rod in its longitudinal direction. The catch member 17 is biased by a spring, not shown in the drawings, which holds it in its position inserted into the interior space 13 of the guide cylinder 8 against a suitably provided stop, also not shown in the drawings. The magnetic drive retracts the catch member 17 from the interior space 13 against the force of this spring. The positioning member 20 is correspondingly also a rod movable in the direction of its axis 20', which likewise runs through the diametral plane 22 passing through the axis 16 of the guide cylinder 8 and through the opening of the window 11. Its drive member 21 is likewise a magnetic drive acting on the rod in its longitudinal direction, which moves the positioning member 20 against the force of a spring, again not shown, into the interior space 13, the spring holding the positioning member 20 in its position retracted from the interior space 13 of the guide cylinder 8. The catch member 17 and the positioning member 20 are inclined downwards at the end of the rods facing the axis 16 of the guide cylinder 8, the rod axes 17' and 20' making an angle of approximately 10° to the horizontal and being substantially perpendicular to the axis 5' of the cup 5 tilted against the window margin 15. The drives 18, 21 are formed as electrically operated pull magnets. The rod axes 17', 20' of both the catch member 17 and the positioning member 20 lie in the common plane 22, parallel to one another.

Figure 3:
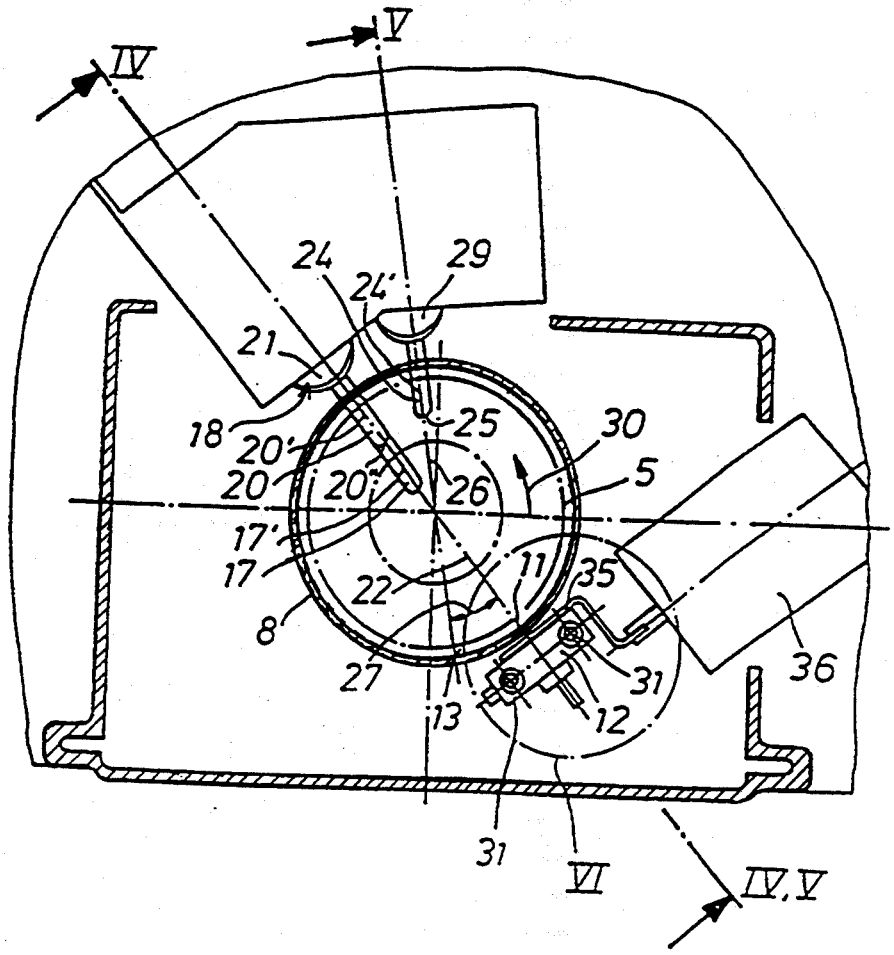
FIG. 3 is the section III—III in FIG. 2.

Furthermore a plunger 24 is provided on the guide cylinder 8, with which it is possible to make the cup 5 held on the catch member 17 and applied by the positioning member 20 against the window margin 15 rotate about the cup axis 5', where the positioning member 20 only projects so far into the interior space 13 of the guide cylinder 8 that a clear space exists between the window margin 15 and the rod end 20'' of the positioning member 20 which leaves a small amount of play for the cup 5 located therebetween, making its rotational movement possible. The testing of the cup marking 4 by the reflective light beam detector 12 and signal processing circuit 14 is repeated many times during the rotary movement, so that a reliable marking test is effected even when the marking 4 should be damaged or dirty locally along the periphery of the cup. The rotation of the cup 5 with the aid of the plunger 24 is achieved in that the plunger 24 is repeatedly struck forward from a position withdrawn from the interior space 13 of the guide cylinder 8 into the interior space 13, each time to strike the plunger head 25 against the sidewall of the cup. The plunger 24 is arranged alongside the positioning member 20 in the peripheral direction of the guide cylinder 8 and at approximately the same height. The plunger 24 runs in a plane 26 parallel to the axis 16 of the guide cylinder 8, which can intersect the diametral plane 22 passing through the axis 16 of the guide cylinder 8 and opening of the window 11 in the region between the axis 16 of the guide cylinder 8 and the margin 15 of the window 11. Particularly good results relative to the rotation of the cup are obtained however in the limit case in which the plane 26 containing the axis 24' of the plunger 24 passes through the axis 16 of the guide cylinder 8, the plunger 24 therefore also running in a diametral plane, this plane making an angle 27 of 30° with the diametral plane 22 defined by the rod axes 17' and 20' of the catch and positioning members 17 and 20. The plunger 24 is moreover inclined to the horizontal in the same manner as the catch and positioning members 17, 20, so that the plunger axis 24' likewise makes an angle of approximately 10° with the horizontal and is approximately perpendicular to the axis 5' of the cup 5 applied against the margin 15 of the window 11. The plunger 24 is held by a spring, again not shown, in the retracted position out of the interior space 13 of the guide cylinder 8 and is struck forward against the cup 5 against the spring's force by an electromagnetic drive 29, especially a pull magnet, where the forward end position of the plunger 24 is limited by a stop, not shown in the drawings. This forward end position is so selected that the plunger 24 deforms the cup wall elastically, with the cup 5 abutting the positioning member 20 on the one side and on the other side the wall of the guide cylinder 8 approximately in the region of the window 11. When the plunger 24 bounces back after the blow, the cup wall springs back elastically into its original shape, whereby rotation of the cup 5 surprisingly occurs in the direction of the arrow 30 applied to FIG. 3, i.e. in the direction opposite the striking direction of the plunger 24. In accordance with the sequential plunger blows there is a stepwise cup rotation, which amounts to 3 to 5 mm for example in the peripheral direction in the region of the window 11 under typical practical conditions.

The window 11 extends in the direction of the axis 16 of the guide cylinder 8 over a part of the cup height and the reflective light beam detector 12 is adjustable in this direction on a support 31 over the height of the window 11. The reflective light beam detector 12 can therefore be adjusted to marking regions on the cups 5 at different heights. Moreover the reflective light beam detector 12 has in the embodiment two reading tracks 32 lying above one another in the axial direction 16 of the guide cylinder 8, each with its own light emitting and light receiving elements. It is in the result possible with the aid of these two reading tracks 32 and the height adjustment of the reflective light beam detector 12, as well as by changes in the signal processing to convert the device to a multiplicity of different cup markings 4, so that different installers of cup return automats 2 can each use their own markings for their cups. From this results the possibility in particular that the reflective light beam detector 12 and the catch member 17 are so arranged together in the axial direction 16 of the guide cylinder 8 that the cup marking 4 is only detected by the reflective light beam detector 12 when the cup 5 is held in the guide cylinder 8 in the right orientation, thus in the embodiment with the cup mouth directed downwards, so that on dropping into the stacking shaft 9 it can be stacked immediately. If the cup is standing the wrong way round in the guide cylinder 8 in this respect, so that no stacking is possible, there is no release of the cup in the guide cylinder 8 and no return of deposit, so that the cup must be taken out of the guide cylinder 8 by hand and be placed in the guide cylinder again in the inverted orientation.

Figure 6:
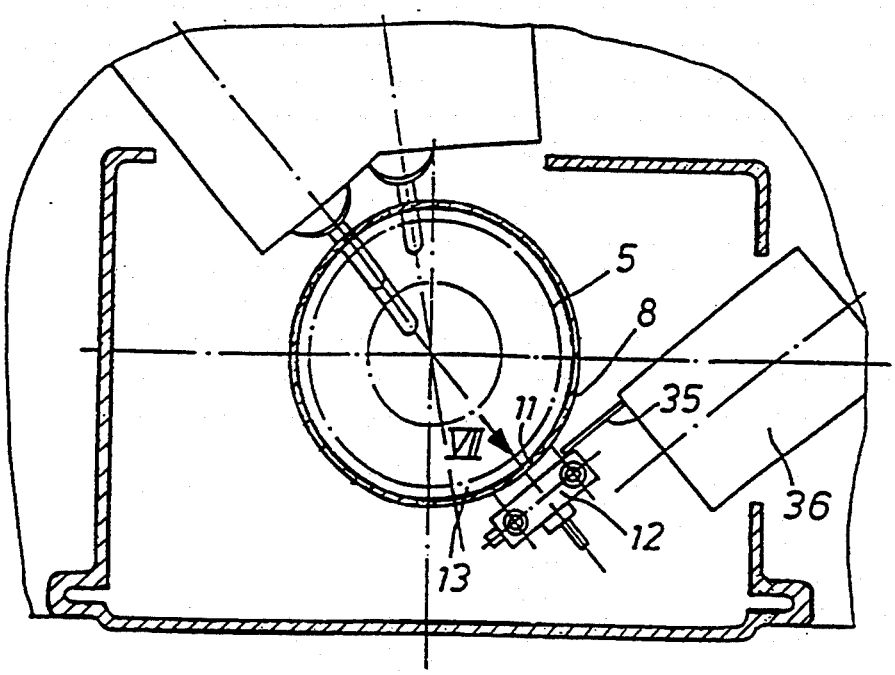
FIG. 6 is the detail marked VI in FIG. 3 in another operating state.

In the event, the manner of operation of the cup return automat 2 can be as described in brief below: When the sliding door 3 of the cup insertion chamber 1 is opened, the positioning member 20 is retracted from the interior space 13 of the guide cylinder 8, so that the cup can be inserted in the guide cylinder 8 and be held by means of the catch member 17. The positioning member 20 moves after closure of the door 3 against the cup 5 in the interior space 13 of the guide cylinder 8 and brings the cup 5 into abutment with the guide cylinder in the region of the window 11 and the reflective light beam detector 12. The reflective light beam detector 12 is enabled to detect the cup marking 4, for which the shutter 35 otherwise covering the reflective light beam detector 12 is drawn back by a pull magnet 36 into the position shown in FIG. 6. If the cup 5 in not recognized in the marking test, the plunger 24 begins to strike against the cup wall so that the cup 5 rotates and the marking test is repeated many times, until the signal processing circuit 14, on correct recognition, causes the catch member 17 to retract from the interior space 13 of the guide cylinder 8, so that the cup 5 can fall down out of the guide cylinder 8 into the stacking shaft 9. At the same time the door 3 to the cup insertion chamber 1 is locked briefly, the shutter 35 of the reflective light beam detector 12 is put back again and the refund of the deposit is enabled. If however the cup 5 is not recognized as correct during the rotation within a predetermined interval of time, for example 10 seconds, a signal lamp lights up to indicate that the cup 5 will not be accepted and no return of deposit will be made.

I claim:

1. An apparatus for checking an optically detectable marking on a surface of a cup for the purposes of cup acceptance or rejection in a cup return apparatus, said checking apparatus comprising:

a guide cylinder, for receiving a cup, and having upper and lower open ends and a sidewall having a window therein;

at least one reflective light beam detector arranged outside said guide cylinder adjacent said window, said detector having a detection region directed into an interior space of said guide cylinder;

a signal processing circuit electrically connected to said detector and which evaluates said optically detectable marking on said cup detected by said light beam detector;

a catch member;

a positioning member, said catch and positioning members being arranged in axial projection diametrically opposite said window and in said guide cylinder below said window, with said positioning member lying between said window and said catch member; and controllable drive means for moving said catch and positioning members into and/or out of said interior space of said guide cylinder, whereby, when said catch and positioning members are positioned in said interior space, the catch member prevents said cup falling through said guide cylinder, and said positioning member applies said cup held on said catch member against said window; and a stacking shaft below said guide cylinder, said shaft being located and orientated relative to said guide cylinder so as to receive said cup falling down out of said guide cylinder after release of said catch member.

2. The apparatus of claim 1, wherein said catch member comprises:

a movable rod;

a spring, which biases said rod into said interior space of said guide cylinder;

wherein said drive means for said catch member comprises a linear motor acting on said rod in its longitudinal direction and which, when activated, retracts said rod from said interior space.

3. The apparatus of claim 1, wherein said positioning member comprises:

a movable rod; and a spring, biasing said rod out of said interior space of said guide cylinder;

said drive member for said positioning member comprising a linear motor acting on said rod in its longitudinal direction and which inserts said positioning member into said interior space against said spring.

4. The apparatus of claim 2, wherein said catch member is inclined downwards at an angle of about 10° to the horizontal.

5. The apparatus of claim 3, wherein said positioning member is inclined downwards at an angle of about 10° to the horizontal.

6. The apparatus of claim 1, wherein said catch member and said positioning member are arranged substantially parallel to one another.

7. The apparatus of claim 1, wherein said window extends along said guide cylinder over a part of the cup height and said reflective light beam detector is adjustable in this direction over the height of said window.

8. The apparatus of claim 1, wherein said reflective light beam detector comprises a plurality of at least two light tracks lying one above the other for testing said marking.

9. The apparatus of claim 1, wherein said reflective light beam detector and said catch member are so spaced from one another in axial direction of said guide cylinder that, with a cup held on said catch member, said cup marking is only at the height of said reflective light beam detector when said cup is located in said guide cylinder with the mouth of said cup directed downwards.

10. An apparatus as defined in claim 1, further comprising a cup having one open end, said cup being located in said guide cylinder and orientated with said open end toward said stacking shaft.

11. An apparatus for checking a marking on a cup for the purposes of cup acceptance or rejection in a cup return apparatus, said checking apparatus comprising:

a guide cylinder, for receiving a cup, and having upper and lower open ends and a sidewall having a window therein;

at least one reflective light beam detector arranged outside said guide cylinder adjacent said window, said detector having a detection region directed into an interior space of said guide cylinder;

a signal processing circuit electrically connected to said detector and which evaluates said optically detectable marking on said cup detected by said light beam detector;

a catch member;

a positioning member, said catch and positioning members being arranged in axial projection diametrically opposite said window and in said guide cylinder below said window, with said positioning member lying between said window and said catch member;

controllable drive means for moving said catch and positioning members into and/or out of said interior space of said guide cylinder, whereby, when said catch and positioning members are positioned in said interior space, the catch member prevents said cup falling through said guide cylinder, and said positioning member applies said cup held on said catch member against said window;

a device for rotating said cup about its axis, when said cup is retained on said catch member and applied against said window by said positioning member said member being inserted into said interior space of said guide cylinder, wherein the distance between said window and said positioning member is selected to provide a small amount of radial play when said cup is between said positioning member and window, so as to facilitate rotary movement of said cup, and wherein testing of said marking by said reflective light beam detector and said signal processing circuit is repeatable during cup rotation; and a stacking shaft below said guide cylinder, said shaft being located and orientated relative to said guide cylinder so as to receive said cup from said guide cylinder after release of said catch member.

12. The apparatus of claim 11, wherein said device for rotating said cup comprises a plunger arranged spaced in a peripheral direction of said guide cylinder from said positioning member and approximately at the same height as this member, said plunger being movable in its longitudinal direction from a position where it would be against said cup to a position withdrawn from said interior space of said guide cylinder, so that, in use, with repeated knocking of said plunger against said cup, said cups can be caused to rotate.

13. The apparatus of claim 12, wherein the angle between said catching and positioning members on the one hand and said plunger on the other hand is about 30°.

14. The apparatus of claim 13, wherein said plunger is inclined to the horizontal in the same manner as said catching and positioning members, said plunger being directed approximately perpendicular to the axis of said cup applied against said window.

15. The apparatus of claim 14, wherein said plunger is held by a spring in a retracted position out of said interior space of said guide cylinder, against which spring said plunger is struck forward against said cup by an electromagnetic drive.

16. An apparatus as defined in claim 11, further comprising a cup in said guide cylinder, said cup having an open end facing toward said stacking shaft.

17. Apparatus for checking an optically detectable marking on a cup to determine whether to accept or reject the cup in a cup collection apparatus, said checking apparatus comprising;

a detector for said optically detectable marking;

means for retaining a cup in a position in said checking apparatus that enables said optically detectable marking to be evaluated by said detector;

means for retracting said retaining means when an determination of appropriate marking has beenmade so that said cup then passes through said checking apparatus; and stacking means below said guide cylinder for receiving the open end of said cups and stacking them upon a shaft after release of said retaining means.

18. An apparatus as defined in claim 17, further comprising a cup in said cup retaining means, said cup having an open end facing toward said stacking means.

19. An apparatus for checking an optically detectable marking on a surface of a cup for the purposes of cup acceptance or rejection in a cup return apparatus, said checking apparatus comprising:

a guide cylinder, for receiving a cup, and having upper and lower open ends and a sidewall having a window therein;

at least one reflective light beam detector arranged outside said guide cylinder adjacent said window, said detector having a detection region directed into an interior space of said guide cylinder;

a signal processing circuit electrically connected to said detector and which evaluates said optically detectable marking on said cup detected by said light beam detector;

a catch member;

a positioning member, said catch and positioning members being arranged in axial projection diametrically opposite said window and in said guide cylinder below said window, with said positioning member lying between said window and said catch member;

controllable drive means for moving said catch and positioning members into and/or out of said interior space of said guide cylinder, whereby, when said catch and positioning members are positioned in said interior space, the catch member prevents said cup falling through said guide cylinder, and said positioning member applies said cup held on said catch member against said window; and a device for rotating said cup about its axis, when said cup is retained on said catch member and applied against said window by said positioning member said member being inserted into said interior space of said guide cylinder, wherein the distance between said window and said positioning member is selected to provide a small amount of radial play when said cup is between said positioning member and window, so as to facilitate rotary movement of said cup, and wherein testing of said marking by said reflective light beam detector and said signal processing circuit is repeatable during cup rotation.

20. The apparatus of claim 19, wherein said device for rotating said cup comprises a plunger arranged spaced in a peripheral direction of said guide cylinder from said positioning member and approximately at the same height as this member, said plunger being movable in its longitudinal direction from a position where it would be against said cup to a position withdrawn from said interior space of said guide cylinder, so that, in use, with repeated knocking of said plunger against said cup, said cups can be caused to rotate.

21. The apparatus of claim 20, wherein the angle between said catching and positioning members on the one hand and said plunger on the other hand is about 30°.

22. The apparatus of claim 21, wherein said plunger is inclined to the horizontal in the same manner as said catching and positioning members, said plunger being directed approximately perpendicular to the axis of said cup applied against said window.

23. The apparatus of claim 22, wherein said plunger is held by a spring in a retracted position out of said interior space of said guide cylinder, against which spring said plunger is struck forward against said cup by an electromagnetic drive.

* * * * *